US005727649A

United States Patent [19]

Buckley

[11] Patent Number: 5,727,649

[45] Date of Patent: Mar. 17, 1998

[54] LADDER SUPPORTABLE TOOL STORAGE CONTAINER

[76] Inventor: Kevin C. Buckley, 53 Revere Rd., Woburn, Mass. 01801

[21] Appl. No.: 669,045

[22] Filed: Jun. 24, 1996

[51] Int. Cl.[6] ..... E04G 1/00

[52] U.S. Cl. ..... 182/129; 248/210; 248/238

[58] Field of Search ..... 182/129; 248/210, 248/238; 206/372

[56] References Cited

U.S. PATENT DOCUMENTS

| | | | |
|---|---|---|---|
| 3,252,613 | 5/1966 | McGrath | 248/210 X |
| 3,642,240 | 2/1972 | Hershey | 248/210 |
| 4,300,740 | 11/1981 | Killian | 248/238 |
| 4,480,810 | 11/1984 | Hall | 248/238 |
| 4,726,446 | 2/1988 | Perbix | 182/129 X |
| 4,832,193 | 5/1989 | Kime | 206/372 |
| 4,846,346 | 7/1989 | Kime | 206/372 |
| 4,862,994 | 9/1989 | Hughes, Sr. | 182/122 |
| 5,052,581 | 10/1991 | Christ et al. | 220/570 |
| 5,098,052 | 3/1992 | Beck | 248/238 |
| 5,259,502 | 11/1993 | Chan | 206/372 |
| 5,325,966 | 7/1994 | Chang | 206/372 |
| 5,386,907 | 2/1995 | Kahl et al. | 206/372 X |
| 5,429,205 | 7/1995 | Collins | 182/122 |
| 5,429,235 | 7/1995 | Chen | 206/372 X |
| 5,547,080 | 8/1996 | Klimas | 182/129 X |

*Primary Examiner*—Leslie A. Braun
*Assistant Examiner*—Richard M. Smith
*Attorney, Agent, or Firm*—David L. Volk

[57] ABSTRACT

A tool storage container is provided, wherein the container includes a support shelf for resting atop and covering the uppermost platform surface of a ladder. A removable, adjustable hook is attached to the support shelf extending outward, and can clamp the ladder's uppermost platform between the hook and the sidewall of the container. A plurality of separate compartments neatly organize supplies, such as tape measures and screw drivers. A swing-out parts tray further provides easy storage and retrieval of nails, screws, and the like. A hinged lid and a carrying handle in order to accommodate use as a conventional tool storage container.

10 Claims, 3 Drawing Sheets

LADDER SUPPORTABLE TOOL STORAGE CONTAINER

RELATED APPLICATIONS AND DISCLOSURE DOCUMENTS

This application is a continuation of the invention described in the Disclosure Document No. 390,058, dated Jan. 11, 1996.

BACKGROUND OF THE INVENTION

1. Field of the Invention

The present invention relates generally to storage means for tools and accessories and, more particularly, to a tool storage container that is capable of being supported on a ladder in an easily accessible position.

2. Description of the Related Art

As is well-known in the art, tradesmen required to perform upon ladders or other overhead reaching devices encounter a chronic problem associated with storage and access of their tools. Tool boxes in general provide adequate storage; however, the uppermost portions of most ladders are inherently unstable and can therefore provide little support for such tool boxes. Another problem occurs when a tradesman attempts to hand carry several tools up a ladder, resulting in juggling, and inevitably numerous trips down the ladder to retrieve dropped articles.

Numerous attempts have been made to correct for the foregoing problems in a specialized manner. For instance, U.S. Pat. No. 5,429,205, issued in the name of Collins, discloses a ladder platform accessory. However, a ladder platform accessory made in accordance with this reference is permanently affixed to the ladder, and provides merely a staging area, and not a storage area.

Similarly, in U.S. Pat. No. 5,098,052, issued in the name of Beck, a magnetic support tray for ladder shelf is disclosed, and is associated with similar drawbacks.

Other attempts at providing a removable support tray are also known. For example, in U.S. Pat. No. 5,052,581, issued in the name of Christ et al., a ladder-supported holding tray is disclosed. However, even though such a holding tray is attachable and detachable to a ladder, once again it merely provides a staging area, and not a storage area for work tools.

Similarly, U.S. Pat. No. 4,862,994, issued in the name of Hughes, Sr., and U.S. Pat. No. 4,300,740, issued in the name of Killian result in similar limitations.

Consequently, a need has been felt for providing tool boxes for storing tools and accessories which can be removably mounted onto a deployed ladder in a stable manner.

SUMMARY OF THE INVENTION

It is therefore an object of the present invention to provide an improved tool storage container.

It is another object of the present invention to provide an improved tool storage container which is ladder supportable.

Briefly described according to the preferred embodiment of the present invention, a tool storage container is provided, wherein the container includes a support shelf for resting atop and covering the uppermost platform surface of a ladder. A removable, adjustable hook is attached to the support shelf extending outward, and can clamp the ladder's uppermost platform between the hook and the sidewall of the container. The tool storage container of the present invention organizes and provides easy access to tools, supplies, and accessories, thereby eliminating the time-consuming problem of transporting such items up and down the ladder. A plurality of separate compartments neatly organizes supplies, such as tape measures and screw drivers. A swing-out parts tray further provides easy storage and retrieval of nails, screws, and the like. A preferred embodiment of the present invention has a hinged lid and a carrying handle in order to accommodate use as a conventional tool storage container.

An advantage of the present invention is that is that it can provide adequate and specialized storage for tools.

Another advantage of the present invention is that tradesmen required to perform upon ladders or other overhead reaching devices no longer need to juggle the necessary tools and parts while atop the ladder.

A further advantage of the present invention is that is can be mounted on the top platform of a ladder in a stable manner.

Further, a preferred embodiment of the present invention is attachable and detachable, making it capable of being utilized in the manner of a conventional tool box.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
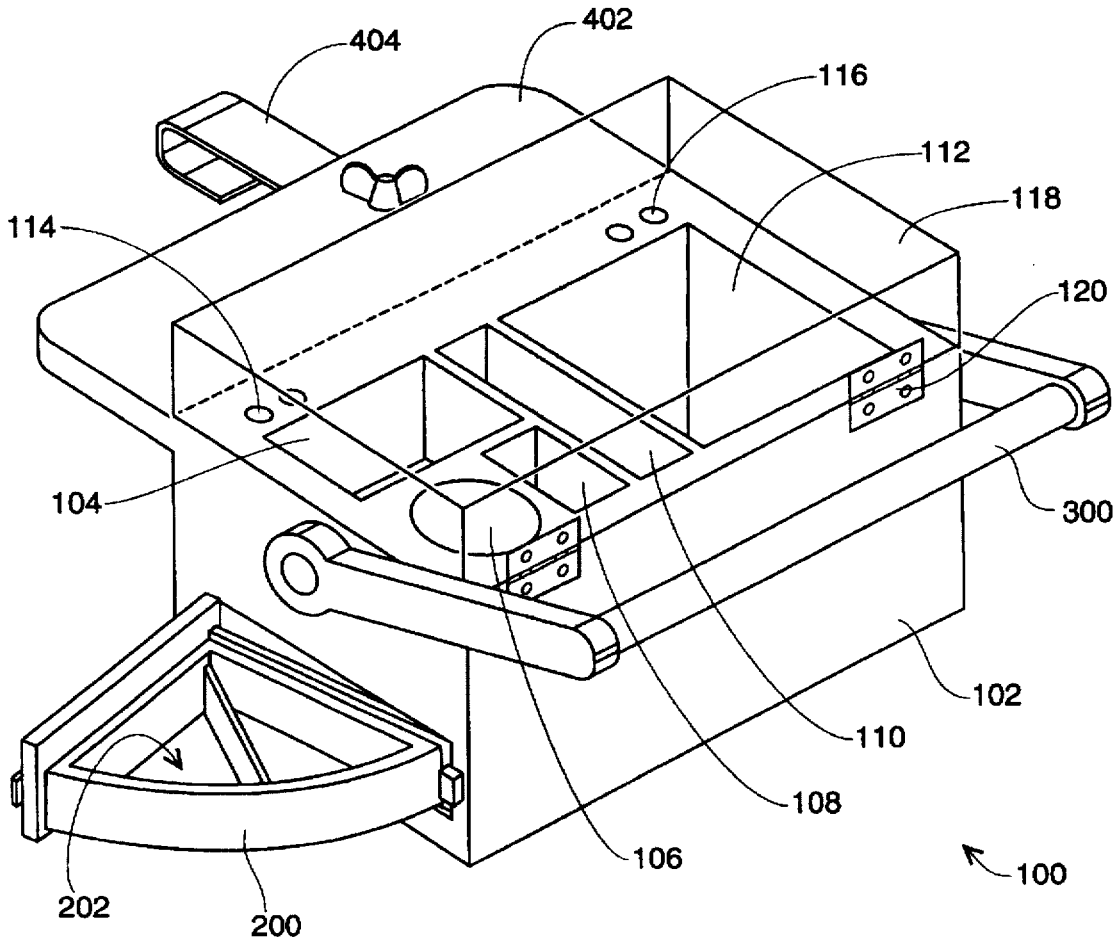
FIG. 1 is a perspective view of the preferred embodiment of the present invention.

Referring now to FIG. 1, a perspective view of the preferred embodiment, a tool storage container 100 is shown, according to the present invention. The container 100 comprises a housing 102 which defines multiple compartments, 104, 106, 108, 110, 112, 114 and 116. Each compartment is designed for general purpose storage, and can accommodate a variety of storage volumes. In the preferred embodiment as shown, the compartments are adapted as a tape measure storage compartment 104, a paste container holder 106, a compartment for holding cleaning brushes 108, a sand cloth tray 110, a main, general purpose storage bin 112, at least one pencil holder 114, and at least one screw driver holder 116. It is felt that it would be obvious to one skilled in the art to modify the configuration and purpose of any of these containers for a variety of customized trades, crafts, or purposes, while remaining within the teachings of the present disclosure.

As further shown in the figures, a lid 118 is attached to the housing 102 with a hinge 120 (or a plurality of hinges 120), such that the lid 118, which is shown in the figures in a closed position, which protects the contents within the interior compartments of the housing 102, may pivot about the hinges 120 to an open position.

Figure 2:
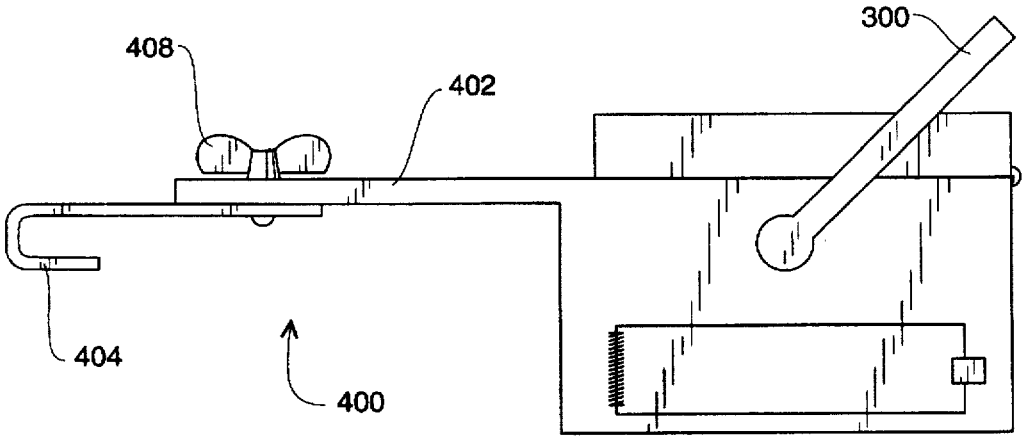
FIG. 2 is a side elevational view thereof.
Figure 3:
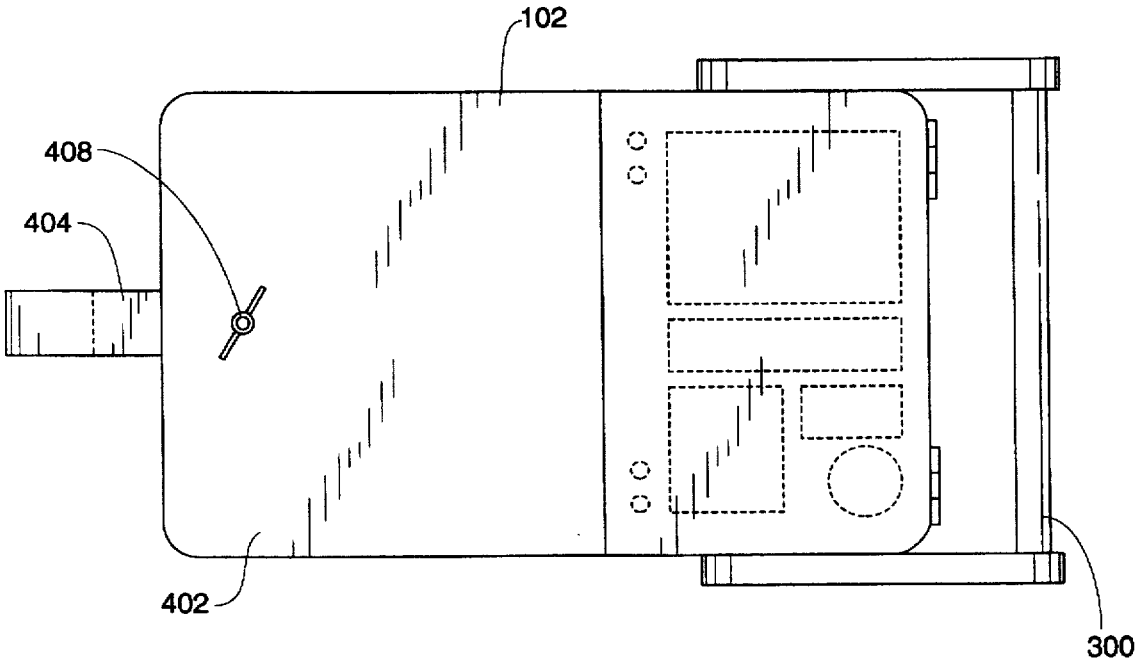
FIG. 3 is a top plan view thereof.
Figure 4:
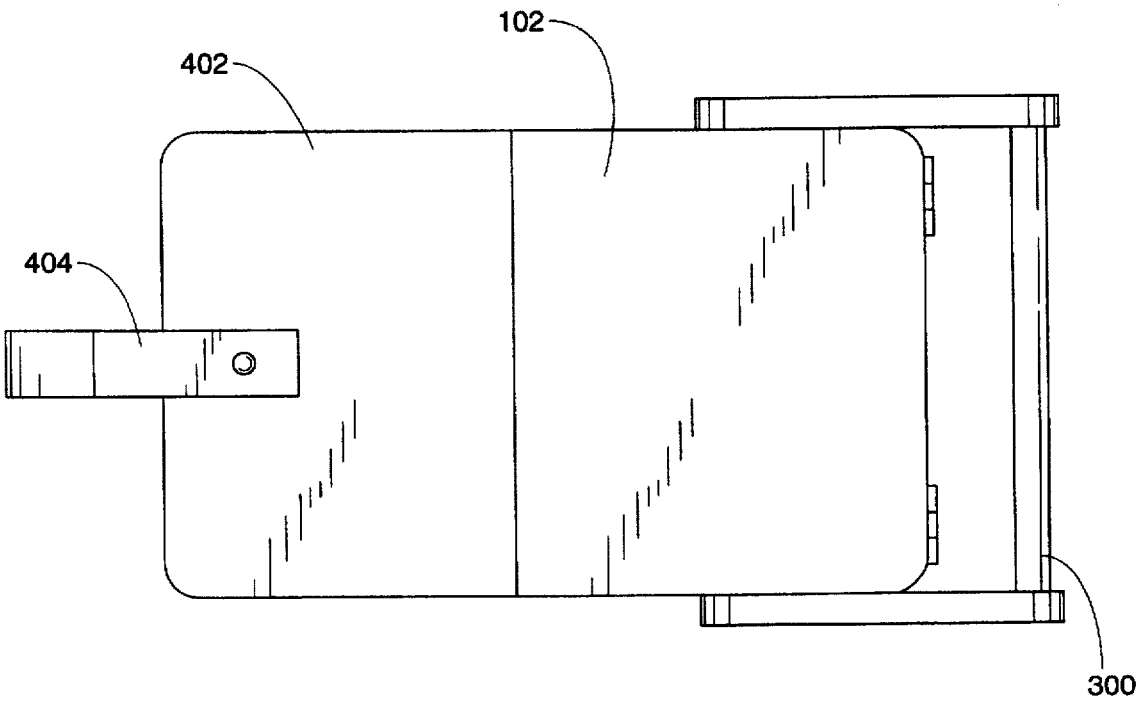
FIG. 4 is a bottom plan view thereof.

A swing out parts tray 200 is further incorporated into one side of the housing 102. As shown in FIG. 1, the tray 200 supports a partitioned storage volume 202. It is envisioned that this partitioned storage volume 202 would hold and accommodate screws, nuts, bolts, nails, and the like. As shown in FIG. 2, the tray 200 is pivotally affixed at one end to the housing 102 such as to close in a manner flush with the side of the housing 102.

Referring to FIG. 1–4, a pivoting handle 300 is attached about the housing 102 in a generally conventional manner. The handle 300 is meant to support the storage container 100 during transporting of the container 100.

Further, a ladder platform attachment means 400 is affixed to the housing 102 for removably attaching the storage container 100 to the top platform of a conventional step ladder (not shown). In its preferred embodiment, the ladder platform attachment means 400 includes a support shelf 402 for resting atop and covering the uppermost platform surface of a ladder. The support shelf 402 is envisioned as laterally extending outward from one side of the housing 102 in order to avoid interference with both the lid 118 and the carrying handle 300. A removable, adjustable hook 404 is attached to the support shelf 402 extending outward, and can clamp the ladder's uppermost platform between the hook 404 and the sidewall of the container 102. An affixment means 408, herein depicted as a conventional wing nut and bold arrangement, provides a means for securing the adjustable hook 404 into a rigid, fixed position.

2. Operation of the Preferred Embodiment

To use the present invention, the tool storage container 100 functions as a conventional tool box that may be used while working on a ladder. Transporting the container 100 may be accomplished by grasping by the handle 300 and easily toting up the ladder. Once the appropriate destination is achieved, the user should lock this unit into place through employment of the adjustable hook 404. The handle 300 may be directed to the side of this housing 102, thereby allowing the user to prop the lid 118 open and access the tools and hardware contained within.

Thus, there has been shown and described a ladder attachable tool storage container which fulfills the objects and advantages souther therefore. Many changes, modifications, and variations and other uses and applications of the subject invention will, however, become apparent to those skilled in the art after considering this specification and the accompanying drawings which disclose a preferred embodiment thereof. All such changes, modifications, variations and other uses and applications which do not depart from the spirit and scope of the invention are deemed to be covered by the invention which is limited only by the claims which follow.

What is claimed is:

1. A tool storage container comprising:

a housing defining a plurality of storage compartments, said housing having a generally rectangular shape having four adjoining sidewalls;

a lid pivotally affixed to said housing via a hinge such that the lid may pivot about said hinge between an open and closed position;

said housing having a base:

structure forming a slot in a first one of said four sidewalls of the housing, said slot above the base when the housing is upright, said slot bounded on four sides thereof by the first sidewall;

a wedge shaped swing out parts tray for holding and accommodating small parts, said tray having an arcuate base and two sides with first and second ends, the first ends of both sides connected to each other and the second ends of both sides connected to the arcuate base, said tray incorporated into said first sidewall of said housing and pivotally affixed at an apex of said tray to said housing such as to close in a manner flush with said first sidewall of said housing, said tray pivotally movable through said slot from a first position within the housing above the base and beneath the storage compartments when the housing is upright, to a second position outwardly extended from the housing;

a pivoting handle attached about the housing in a generally conventional manner for supporting said storage container during transporting of said container; and ladder platform attachment means affixed to said housing for removably attaching said storage container to the top platform of a conventional step ladder.

2. The tool storage container according to claim 1, wherein said plurality of storage compartments includes a tape measure storage compartment.

3. The tool storage container according to claim 1, wherein said plurality of storage compartments includes a paste container holder.

4. The tool storage container according to claim 1, wherein said plurality of storage compartments includes a compartment for holding cleaning brushes.

5. The tool storage container according to claim 1, wherein said plurality of storage compartments includes a sand cloth tray.

6. The tool storage container according to claim 1, wherein said plurality of storage compartments includes at least one pencil holder.

7. The tool storage container according to claim 1, wherein said plurality of storage compartments includes at least one screw driver holder.

8. The tool storage container according to claim 1, wherein said ladder platform attachment means comprises:

a support shelf for resting atop and covering the uppermost platform surface of a ladder, said support shelf affixed to and laterally extending outward from one sidewall of said housing;

a removable, adjustable hook attached to said support shelf and extending outward therefrom; and affixment means for securing said hook in a rigid, fixed position.

9. The tool storage container according to claim 8, wherein said affixment means comprises a conventional wing nut and bolt arrangement penetrating and securing both said hook and said shelf.

10. The tool storage container according to claim 1, wherein said plurality of storage compartments includes:

a first compartment adapted to hold a tape measure;

a round second compartment adapted to hold a paste container;

a third compartment adapted to hold cleaning brushes;

a fourth compartment adapted to hold a sand cloth;

a fifth compartment adapted to hold a pencil;

a sixth compartment adapted to hold a screwdriver; and a general purpose storage bin.

* * * * *